US007448779B2

(12) United States Patent
Coushaine

(10) Patent No.: US 7,448,779 B2
(45) Date of Patent: Nov. 11, 2008

(54) MINIATURE PORTABLE LAMP WITH SWING ARM

(75) Inventor: Charles M. Coushaine, Rindge, NH (US)

(73) Assignee: Osram Sylvania Inc., Danvers, MA (US)

( * ) Notice: Subject to any disclaimer, the term of this patent is extended or adjusted under 35 U.S.C. 154(b) by 42 days.

(21) Appl. No.: 11/433,193

(22) Filed: May 13, 2006

(65) Prior Publication Data

US 2007/0047245 A1 Mar. 1, 2007

Related U.S. Application Data

(60) Provisional application No. 60/710,966, filed on Aug. 24, 2005.

(51) Int. Cl.
*F21S 8/00* (2006.01)

(52) U.S. Cl. ..... 362/427; 362/188; 362/269; 362/285

(58) Field of Classification Search ..... 362/427, 362/184, 188, 247, 269, 285
See application file for complete search history.

(56) References Cited

U.S. PATENT DOCUMENTS

| | | | | |
|---|---|---|---|---|
| 4,494,177 | A * | 1/1985 | Matthews | 362/402 |
| 5,136,477 | A | 8/1992 | Lemmey et al. | |
| 5,825,637 | A | 10/1998 | Chen et al. | |
| 6,457,841 | B1 * | 10/2002 | Lynch et al. | 362/199 |
| 6,776,501 | B2 * | 8/2004 | Burnidge | 362/156 |
| D497,216 | S * | 10/2004 | Lee | D26/60 |
| 7,249,864 | B2 * | 7/2007 | Smith et al. | 362/183 |
| 2004/0062047 | A1 * | 4/2004 | Camarota et al. | 362/399 |
| 2004/0228124 | A1 | 11/2004 | Reiff et al. | |
| 2005/0073837 | A1 | 4/2005 | Jian et al. | |
| 2005/0094385 | A1 * | 5/2005 | Lee | 362/98 |
| 2005/0157496 | A1 | 7/2005 | Chen | |

FOREIGN PATENT DOCUMENTS

EP 1 541 918 A2 6/2005

OTHER PUBLICATIONS

European Search Report for European Application No. EP 06 01 6362, dated Oct. 3, 2006.

* cited by examiner

*Primary Examiner*—Ali Alavi
*Assistant Examiner*—Evan Dzierzynski
(74) *Attorney, Agent, or Firm*—Carlos S. Bessone

(57) ABSTRACT

A lamp (10) has a base (12) including a longitudinal axis (14) extending in a first direction (16) and a transverse axis (18) extending in a second direction (20) normal to the longitudinal axis (14). A pivot arm (22) is mounted on the base (12) for rotation through 180 degrees about the transverse axis (18) and at least one LED (24) is mounted with the pivot arm (22). Electrical means (26) are enclosed in the base (12) and pivot arm (22) for supplying electrical energy to the at least one LED (24). A cover 30 is mounted with the base (12) and is rotational about the longitudinal axis (14).

18 Claims, 2 Drawing Sheets

MINIATURE PORTABLE LAMP WITH SWING ARM

CROSS-REFERENCE TO RELATED APPLICATION

This application claims priority from Provisional Patent Application No. 60/710,966, filed Aug. 24, 2005.

TECHNICAL FIELD

The invention relates to electric lamps and particularly to portable electric lamps. More particularly the invention is concerned with a miniature portable lamp with a pivot arm.

BACKGROUND ART

Portable lamps generally have comprised battery-operated units using incandescent or fluorescent lamps. Such lamps generally have a fixed direction of illumination. The advent of light emitting diodes (LEDs) has allowed a substantial decrease in the size and weight of portable lamps. However, it would be an advance in the art if an LED lamp could be provided that had a wide range of illumination coverage.

DISCLOSURE OF INVENTION

It is therefore an object of the invention to obviate the disadvantages of the art.

It is another object of the invention to enhance lamp operation.

These objects are accomplished, in one aspect of the invention, by a lamp comprising: a base including a longitudinal axis pointing in a first direction and a transverse axis normal to the longitudinal axis; a pivot arm mounted on the base for rotation about the transverse axis; at least one LED mounted on the pivot arm; and electrical means enclosed in the base and pivot arm for supplying electrical energy to said at least one LED.

BEST MODE FOR CARRYING OUT THE INVENTION

Figure 1:
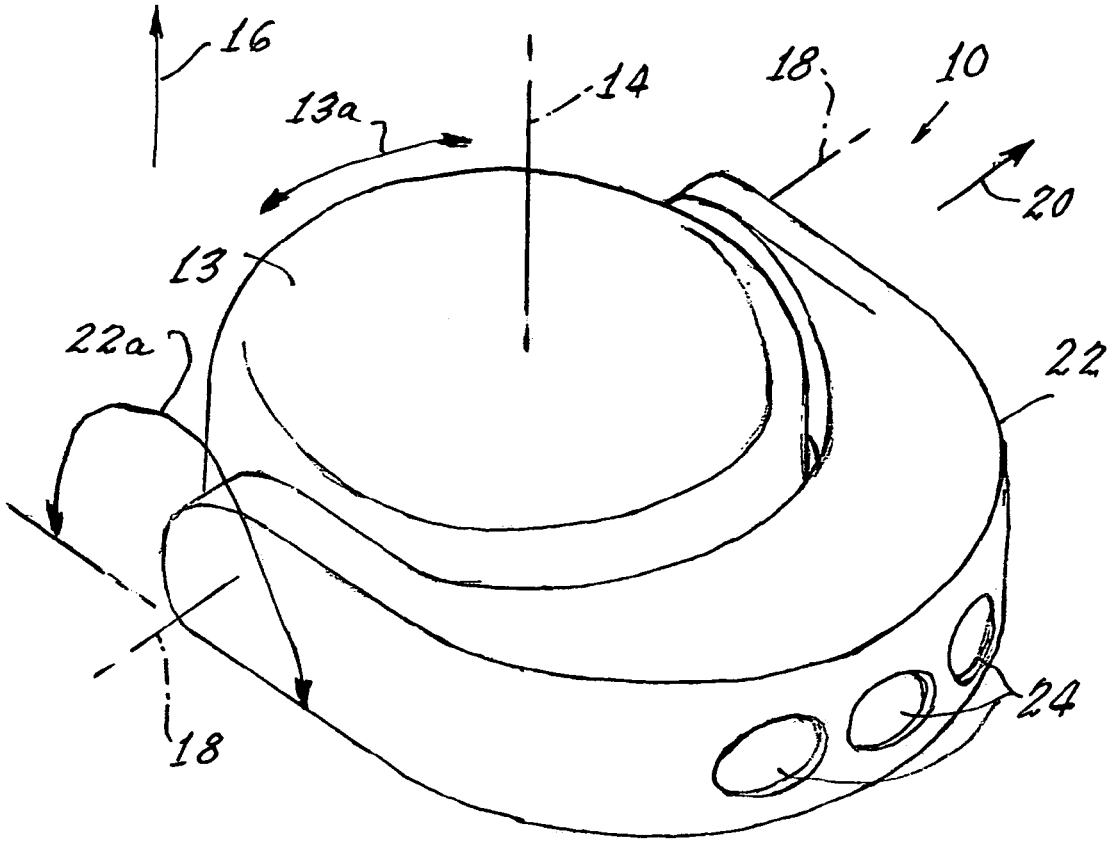
FIG. 1 is a perspective of an embodiment of the invention.
Figure 2:
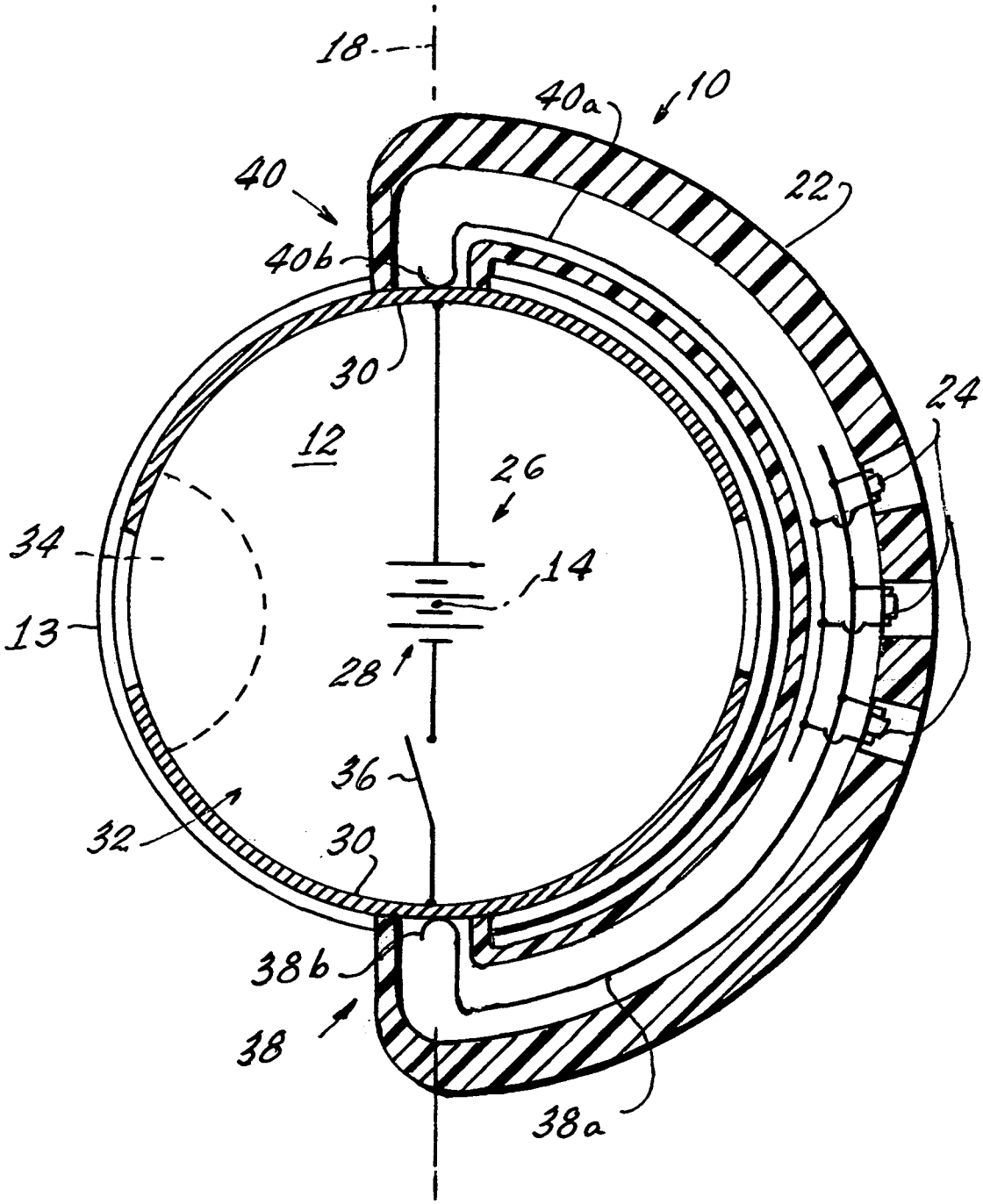
FIG. 2 is a diagrammatic sectional plan view of an embodiment of the invention.

For a better understanding of the present invention, together with other and further objects, advantages and capabilities thereof, reference is made to the following disclosure and appended claims taken in conjunction with the above-described drawings.

Referring now to the drawings with greater particularity, there is shown a lamp 10 comprising a base 12 including a longitudinal axis 14 extending in a first direction 16 and a transverse axis 18 extending in a second direction 20 normal to the longitudinal axis 14. A pivot arm 22 is mounted on the base 12 for 180 degrees of rotation about the transverse axis 18 as shown by arrow 22*a* and at least one LED 24 is mounted with the pivot arm 22. In a preferred embodiment of the invention there are three LEDs 24. Electrical means 26 comprising at least one battery 28 and battery contacts 30 are enclosed in a suitably formed cavity 32 within in the base 12 and electrical connections 38*a* and 40*a* are included within the pivot arm 22 for supplying electrical energy to the LEDs 24. A switch 36 is provided for energizing the LEDs. A suitable door 34 is included in the base 12 for access to the batteries for replacement purposes.

The base 12 has the general form of a cylinder having a greater diameter than its height and a front cover 13, the front cover 13 being at least partially rotationally adjustable around said longitudinal axis 14 with respect to the base 12. The cover 13 is rotatable relative to the base 12 and in a preferred embodiment is rotatable for at least 120 degrees about the longitudinal axis 14 as shown by the arrow 13*a*. The rotational cover allows for added directional coverage of the illumination from the LEDs and, additionally, can have the on/off switch incorporated therein, eliminating the need for a separate switch.

The pivot arm 22 is rotationally coupled to the base 12 at a first end 38 and a second end 40 along the transverse axis 18 and the ends include a spring connection 38*b* and 40*b* respectively, that make the electrical connection to the battery contacts 30.

If desired, mounting means such as double-sided adhesive tape or a suction cup can be affixed to the back side of the base 12 allowing the lamp 10 to be removeably mounted in convenient location.

Thus there is provided a small and portable lamp that has wide illumination coverage.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp comprising: a base including a longitudinal axis pointing in a first direction and a transverse axis normal to the longitudinal axis; a pivot arm mounted on the base for rotation about the transverse axis; at least one LED mounted on the pivot arm; and electrical means enclosed in the base and pivot arm for supplying electrical energy to said at least one LED, wherein said base includes a back and a front cover, said back cover including a mounting face, said base being at least partially rotationally adjustable about said longitudinal axis with respect to the back cover.

2. The lamp of claim 1, wherein said base has the general form of a cylinder having a greater diameter than height.

3. The lamp of claim 1, wherein said electrical means enclosed in said base comprises at least one battery, battery contacts and a cavity sufficient to retain said batteries, and a door to access said cavity for battery replacement.

4. The lamp of claim 1, wherein said base includes a switch supplying and removing electrical power to said at least one LED.

5. The lamp of claim 1, wherein said pivot arm is rotationally coupled to said base at a first end and a second end along an axis transverse to said longitudinal axis.

6. The lamp of claim 5, wherein said first end includes a first electrical connection.

7. The lamp of claim 6, wherein said second end includes a second electrical connection.

8. The lamp of claim 5, wherein said pivot arm is rotationally mounted to the base along an axis transverse to said longitudinal axis having a rotational range of at least 180 degrees.

9. The lamp of claim 8 wherein said base is rotatable for at least 350 degrees about said longitudinal axis with respect to the back cover.

10. A lamp comprising: a base including a longitudinal axis pointing in a first direction and a transverse axis normal to the longitudinal axis; a pivot arm mounted on the base for rotation about the transverse axis; at least one LED mounted on the pivot arm; and electrical means enclosed in the base and pivot arm for supplying electrical energy to said at least one LED, wherein said base includes a back and a front cover, said back cover including a mounting face, said base being at least partially rotationally adjustable about said longitudinal axis with respect to the back cover, and wherein the longitudinal axis of at least one LED is oriented perpendicular to and intersecting the transverse axis of the base.

11. The lamp of claim 10, wherein said base has the general form of a cylinder having a greater diameter than height.

12. The lamp of claim 10, wherein said electrical means enclosed in said base comprises at least one battery, battery contacts and a cavity sufficient to retain said batteries, and a door to access said cavity for battery replacement.

13. The lamp of claim 10, wherein said base includes a switch supplying and removing electrical power to said at least one LED.

14. The lamp of claim 10, wherein said pivot arm is rotationally coupled to said base at a first end and a second end along an axis transverse to said longitudinal axis.

15. The lamp of claim 14, wherein said first end includes a first electrical connection.

16. The lamp of claim 15, wherein said second end includes a second electrical connection.

17. The lamp of claim 14, wherein said pivot arm is rotationally mounted to the base along an axis transverse to said longitudinal axis having a rotational range of at least 180 degrees.

18. The lamp of claim 17 wherein said base is rotatable for at least 350 degrees about said longitudinal axis with respect to the back cover.

* * * * *